US007882681B2

(12) United States Patent
Bernhard

(10) Patent No.: US 7,882,681 B2
(45) Date of Patent: Feb. 8, 2011

(54) BEVERAGE BOTTLE CLOSING APPARATUS CONFIGURED TO CLOSE BEVERAGE BOTTLES IN A BEVERAGE BOTTLING PLANT

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 264 days.

(21) Appl. No.: 11/985,574

(22) Filed: Nov. 15, 2007

(65) Prior Publication Data

US 2008/0115457 A1 May 22, 2008

Related U.S. Application Data

(63) Continuation of application No. 11/213,314, filed on Aug. 26, 2005, now abandoned.

(30) Foreign Application Priority Data

Aug. 28, 2004 (DE) ..... 10 2004 041 749

(51) Int. Cl.
*B67B 3/28* (2006.01)
*B67B 3/20* (2006.01)

(52) U.S. Cl. ..... 53/317; 53/300; 53/329; 53/331; 53/331.5; 53/484; 53/485

(58) Field of Classification Search ..... 53/329, 53/331, 484, 485, 300, 317, 331.5
See application file for complete search history.

(56) References Cited

U.S. PATENT DOCUMENTS 2,359,932 A * 10/1944 Newey ..... 53/201
2,987,313 A * 6/1961 Bjering et al. ..... 269/14
3,660,963 A * 5/1972 Sullivan ..... 53/488
3,818,785 A * 6/1974 Wakabayashi ..... 82/101
3,831,344 A * 8/1974 Over ..... 53/329
3,852,941 A * 12/1974 Bross ..... 53/317
4,075,820 A * 2/1978 Standley ..... 53/329.4
4,099,361 A * 7/1978 Dix et al. ..... 53/488
4,299,072 A * 11/1981 Holstein ..... 53/306
4,765,115 A * 8/1988 Pollina ..... 52/712
5,121,587 A * 6/1992 Zanini et al. ..... 53/367
5,419,094 A * 5/1995 Vander Bush et al. ..... 53/75
5,473,855 A * 12/1995 Hidding et al. ..... 53/314

(Continued)

FOREIGN PATENT DOCUMENTS

DE 103 08 156.9 * 9/2004

OTHER PUBLICATIONS

Patent and Utility Model Register; German Patent and Trade Mark Office; File No. DE: 103 08 156.9.*

*Primary Examiner*—Rinaldi I Rada
*Assistant Examiner*—Gloria R Weeks
(74) *Attorney, Agent, or Firm*—Nils H. Ljungman & Associates

(57) ABSTRACT

Rotary screwtop container capping arrangement designed to screw screw caps onto screwtop containers having neck rings which support the containers during capping. The capping arrangement has a cam arrangement having a guide roller located in a control groove having top and bottom guide surfaces. A lifting element or rod is connected to the cam arrangement and is moved up and down in a controlled manner to control the lifting and lowering of a container.

20 Claims, 4 Drawing Sheets

U.S. PATENT DOCUMENTS 5,528,879 A * 6/1996 Louy et al. ..... 53/201
5,533,324 A * 7/1996 Furukawa et al. ..... 53/469
6,158,196 A * 12/2000 Trebbi et al. ..... 53/331.5
6,293,003 B1 * 9/2001 Sakurai et al. ..... 29/740
6,662,526 B2 * 12/2003 Riggs et al. ..... 53/308
6,679,026 B1 * 1/2004 Cirio ..... 53/317
6,745,542 B2 * 6/2004 Masumoto ..... 53/317
7,497,145 B2 * 3/2009 El Hachem et al. ..... 74/569
2004/0226261 A1 * 11/2004 Graffin ..... 53/75
2005/0150193 A1 * 7/2005 Bernhard ..... 53/490
2010/0154364 A1 * 6/2010 Bernhard ..... 53/490

* cited by examiner

BEVERAGE BOTTLE CLOSING APPARATUS CONFIGURED TO CLOSE BEVERAGE BOTTLES IN A BEVERAGE BOTTLING PLANT

CONTINUING APPLICATION DATA

This application is a continuation of U.S. application Ser. No. 11/213,314, filed Aug. 26, 2005 now abandoned.

BACKGROUND

1. Technical Field

The present application relates to a beverage bottle closing apparatus configured to close beverage bottles in a beverage bottling plant.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The prior art describes devices for closing or capping containers with screw tops by screwing the caps onto a container-side thread that is realized on the mouth of the container. Closers and cappers of the prior art have, on the periphery of a rotor that is driven in rotation around a vertical machine axis, a plurality of closing positions, each of which is formed by, among other things, a screw head that can be driven in rotation by a drive and a container carrier. For the delivery of the container to be capped, the container carrier can be moved in a first lifting direction upward, i.e. closer to the screw head or to the screw cap that is already present in the screw head, and for the removal of the capped container can be moved downward in a second, operating direction opposite to the first direction.

On a device of this type of the prior art, the container carriers are each moved by a control cam and spring means, so that the movement of each container carrier in the first lifting direction is effected exclusively by means of the spring means, and in the second lowering direction by means of the control cam, and namely counter to the action of the spring means. The spring means then simultaneously provide the "thread adjustment", i.e. the tracking of the respective container in the first lifting direction while the screw cap is screwed tight.

One disadvantage, however, is that in the event of any binding or sluggishness of the lifting element, the container carrier in question and thus also the container that is present on this container carrier are not lifted far enough toward the screw head, and thus the respective screw cap is not screwed onto the container to be capped, or is screwed on only insufficiently.

OBJECT OR OBJECTS

The object is to eliminate this disadvantage and to indicate a closer or capper device, which makes possible a reliable closing or capping of containers with screw caps. The present application teaches that this object can be accomplished by means of a device as described in herein below.

SUMMARY

On the device claimed by the present application, the movement of the lifting element in both directions is controlled desmodromically or non-positively by the cam control system and without the action of a spring element. Between the respective lifting element and the container carrier that is moved by it, at least one spring element is then provided, which applies an initial load to the container carrier relative to the lifting element in the first lifting direction. This spring element, which is used essentially only for the thread adjustment during the capping, and for which accordingly only a small spring travel is necessary, can be realized and the initial load applied so that the respective container with its container mouth is reliably introduced into the screw cap that is held in the screw head, and this screw head can then be correctly screwed onto the container.

Developments of the present application are described in the subclaims. The present application is explained in greater detail below on the basis of the accompanying figures, which show one exemplary embodiment.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1A:
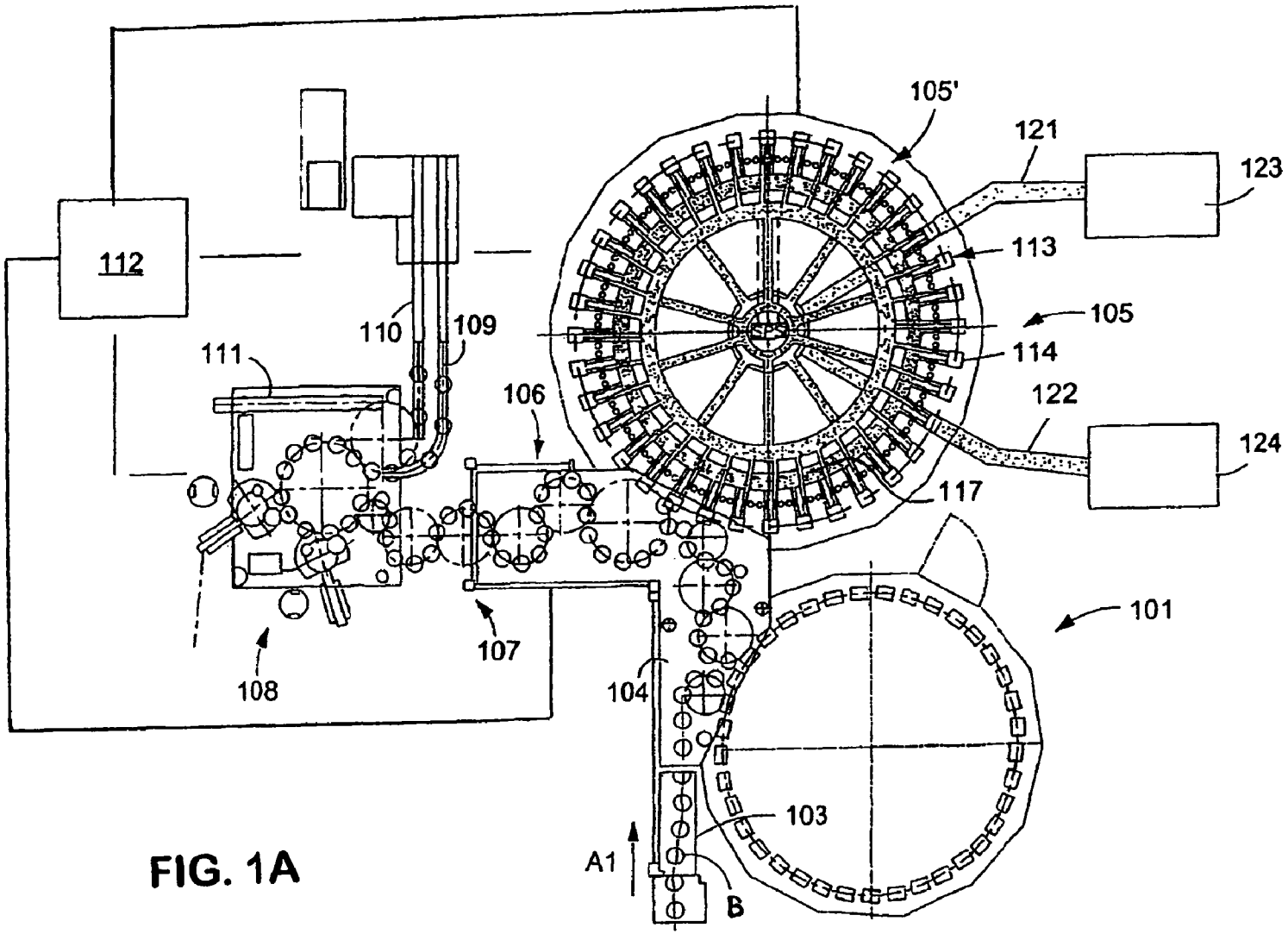
FIG. 1A is a schematic illustration of a container filling plant in accordance with one possible embodiment.
Figure 1:
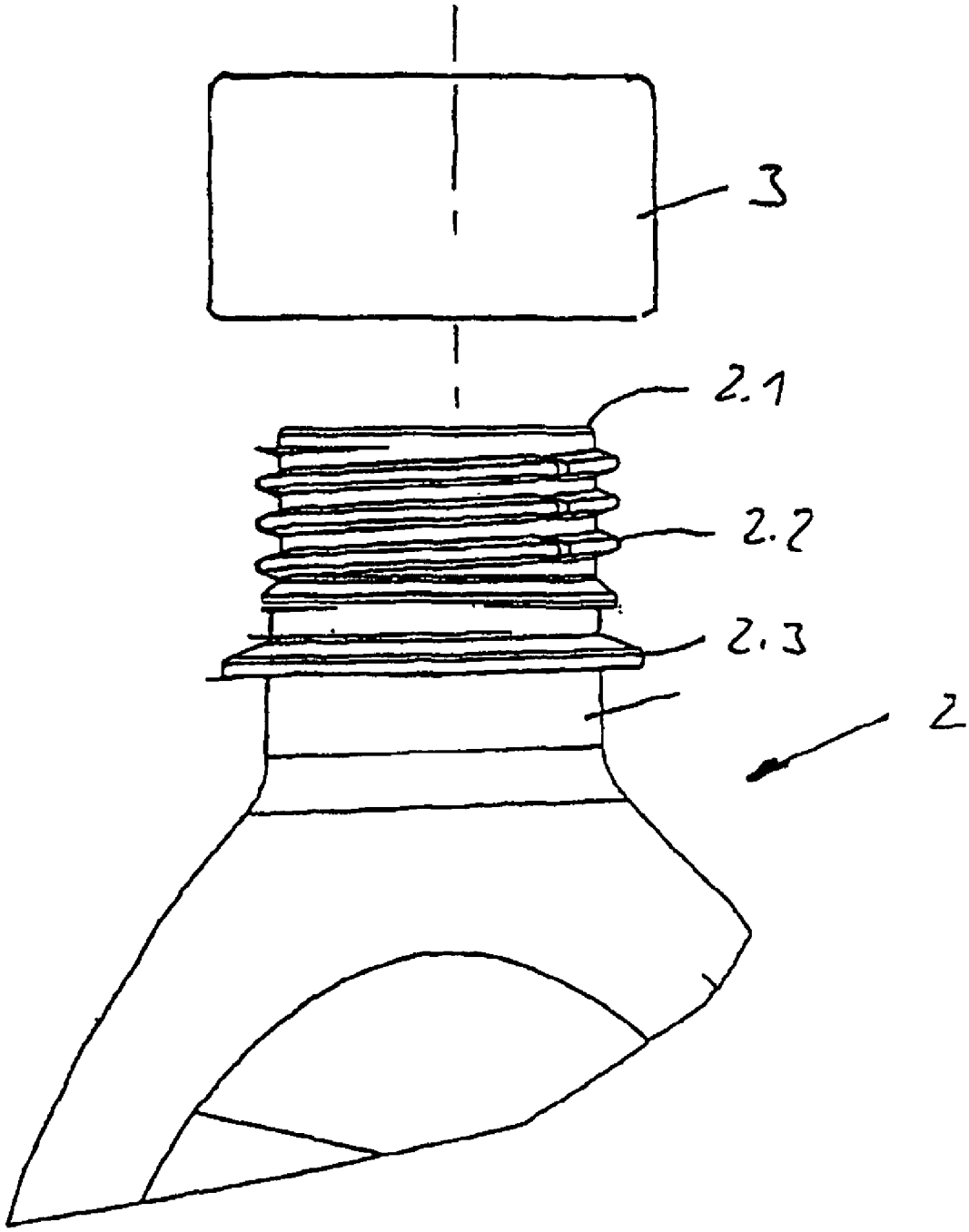
FIG. 1 is a partial view of a bottle, together with a screw cap.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
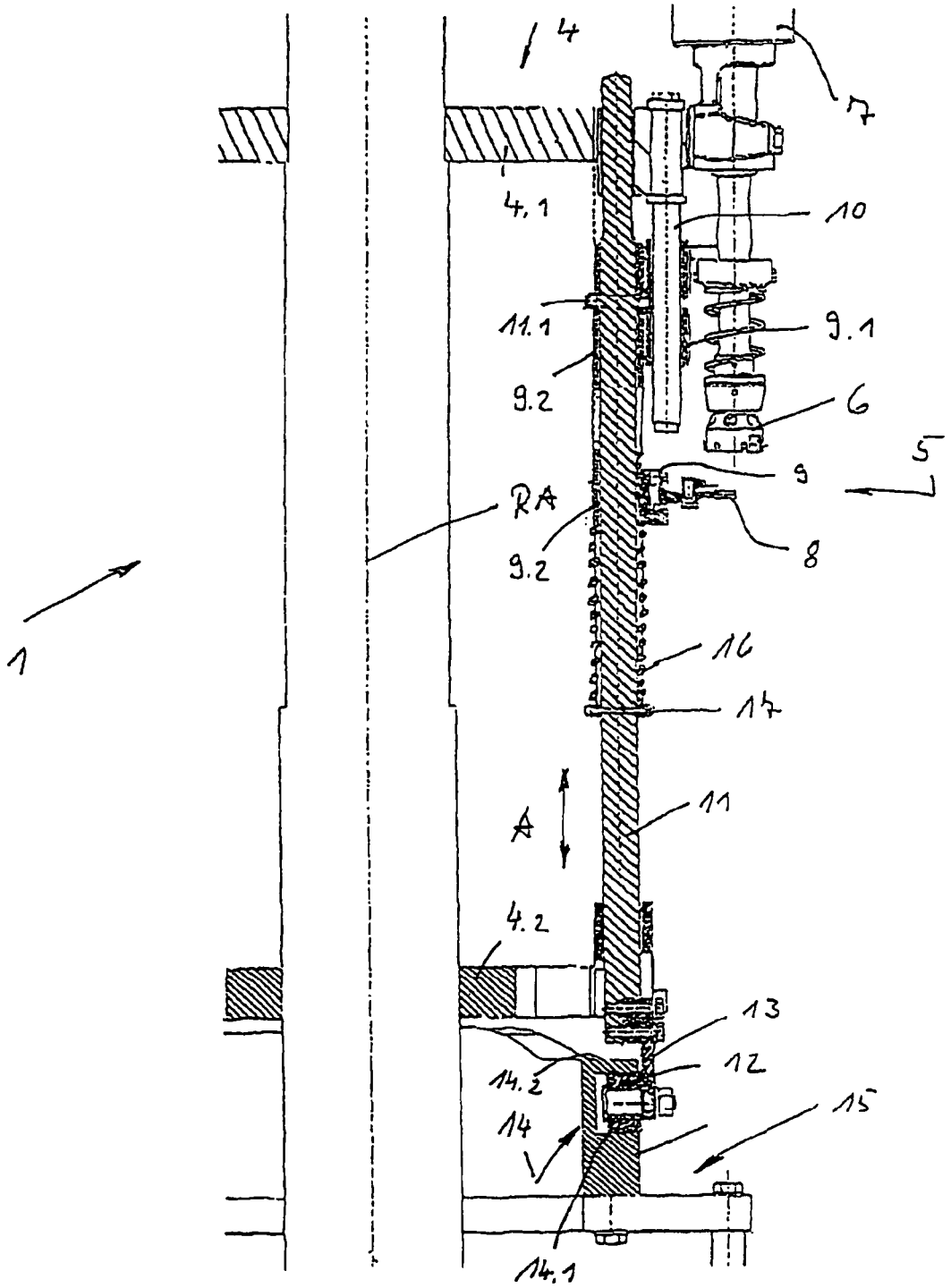
FIG. 2 is a partial view of a capper for capping bottles with the screw cap.

The capper, which is illustrated in FIG. 2, where it is designated 1 in general, is used to cap each bottle 2 with a screw cap 3, and specifically by screwing the screw cap 3, which can be made of plastic, for example, onto the thread 2.2 that is provided in the vicinity of the bottle mouth 2.1.

The capper 1, as described in the prior art, has a rotor 4 which can be driven in rotation around a vertical machine or rotor axis RA, and of which FIG. 2 shows only an upper rotor element 4.1 in the shape of a wheel or disc, and a lower rotor element 4.2 which is also in the shape of a wheel or disc. On the periphery of the rotor 4, distributed at uniform angular intervals around the rotor axis RA, capping positions 5 are formed, each of which has a screw head 6 with a corresponding drive 7, by means of which, during the capping, the screw head 6 which holds a screw cap 3 is rotated around an axis parallel to the rotor axis RA. An additional component of each capping position 5 is a bottle or container carrier 8, on which the respective bottle 2 is held in, among other possible positions, a suspended position, i.e. supported by a flange 2.3. The container carrier 8 is located underneath the screw head 6 and is provided on a carrier element 9 which can be moved up and down in a controlled manner parallel to the rotor axis RA, as indicated by the double arrow A in FIG. 2. For this purpose, the carrier element 9 is guided by means of a guide sleeve 9.1 on at least one guide rod 10 that is held on the upper rotor element 4.1, and is guided with an additional guide sleeve 9.2 on a lifter rod 11 that is oriented with its axis parallel to the rotor axis RA and forms the lifting element. The lifter rod 11 is mounted so that it can be displaced axially in the rotor elements 4.1 and 4.2.

On its lower end, the lifter rod 11 is permanently connected with a bearing element 13 that has a cam roller 12. The cam roller 12, which is mounted so that it can rotate freely around an axis which is radial with respect to the rotor axis RA, is engaged in a control groove 14 which is provided on a part of the machine 15 that does not rotate with the rotor 4. The control groove 14, with its lateral boundary surfaces, forms two control surfaces that interact with the cam roller 12, namely the control surface 14.1 for the desmodromic or non-positive upward movement of the lifter rod 11 and the control surface 14.2 for the desmodromic or non-positive downward movement of the lifter rod 11 downward. The lifter rod 11 is therefore desmodromically controlled by means of the cam roller 12 and the control cam 14 in both directions in its reciprocating vertical movement.

The word "desmodromic" refers to the exclusive valve control system used in Ducati engines: both valve movements (opening and closing) are "operated". To further describe the word "desmodromic", action on the valve is "positive" in both cases, in other words, both strokes are "controlled". In mechanical terms, the word desmodromic is used to refer to mechanisms that have different controls for their actuation in different directions. More information on the term "desmodromic" may be found on Ducati's website, specifically, at http://www.ducati.com. Therefore, in the present application, the lifter rod 11 is desmodromically controlled by the cam roller 12 in both its upward movement toward the screw head 6, and its downward movement away from the screw head 6 upon the bottle being closed with a bottle cap.

On the lifter rod 11, there is a helical compression spring 16 which surrounds said rod, and is supported with its lower end on a leaf spring 17 on the lifter rod 11, and with its upper end on the carrier element 9 or on the lower end of the guide sleeve 9.2. By means of the pre-loaded compression spring 16, the carrier element 9 is elevated on the lifter rod 11 until it is in contact with the upper end of the guide sleeve 9.2 against a stop that is formed by a collar 11.1 of the lifter rod 11.

To cap the bottles 2, the bottles are transferred at a bottle inlet of the capper 1, with the lifter rod 11 lowered, to the corresponding lowered container carriers 8. Then, by means of the control cam or control surface 14.1 formed by the control groove 14, the lifter rod 11 is desmodromically lifted, and the bottle 2 to be capped is thereby introduced with its bottle mouth 2.1 into the screw cap 3 which is already in the screw head 6. The upward stroke of the lifter rod 11 is thereby longer than the stroke that is necessary for this introduction of the bottle mouth 2.1 into the screw cap 3 of the carrier element 9, so that after the introduction of the bottle mouth 2.1 into the screw cap 3, the carrier element 9 and the container carrier 8 no longer directly follow the further upward stroke of the lifter rod 11.

By means of the drive 7, the individual screw cap 3 is screwed onto the thread 2.2 of the bottle 2 to be capped. The compression spring 16 thereby applies the pressure necessary to press the bottle 2 against the screw cap 3 that is held in the screw head 6, and also to some extent for the thread adjustment.

The tracking of the bottle 2 in question that is necessary for the closing or capping relative to the screw head 6 in the vertical direction is effected by a continuation of the upward motion of the lifter rod 11, whereby deviations from the specified path of the upward movement are also partly compensated by a movement of the carrier element 9 relative to the lifter rod 11.

After the capping, for the discharge of the capped bottle 2 at a container outlet of the capper 1, the carrier element 9 and the container carrier 8 are lowered, whereupon the screw cap 3 that is now screwed onto the bottle mouth 2.1 is extracted from the screw head 6.

The special feature of the capper 1 comprises the desmodromic control of the lifter rod 11, so that in particular when the compression spring 16 is realized with sufficient spring force, a secure capping of the bottles 2 is guaranteed at a high output of the capper 1.

Figure 3:
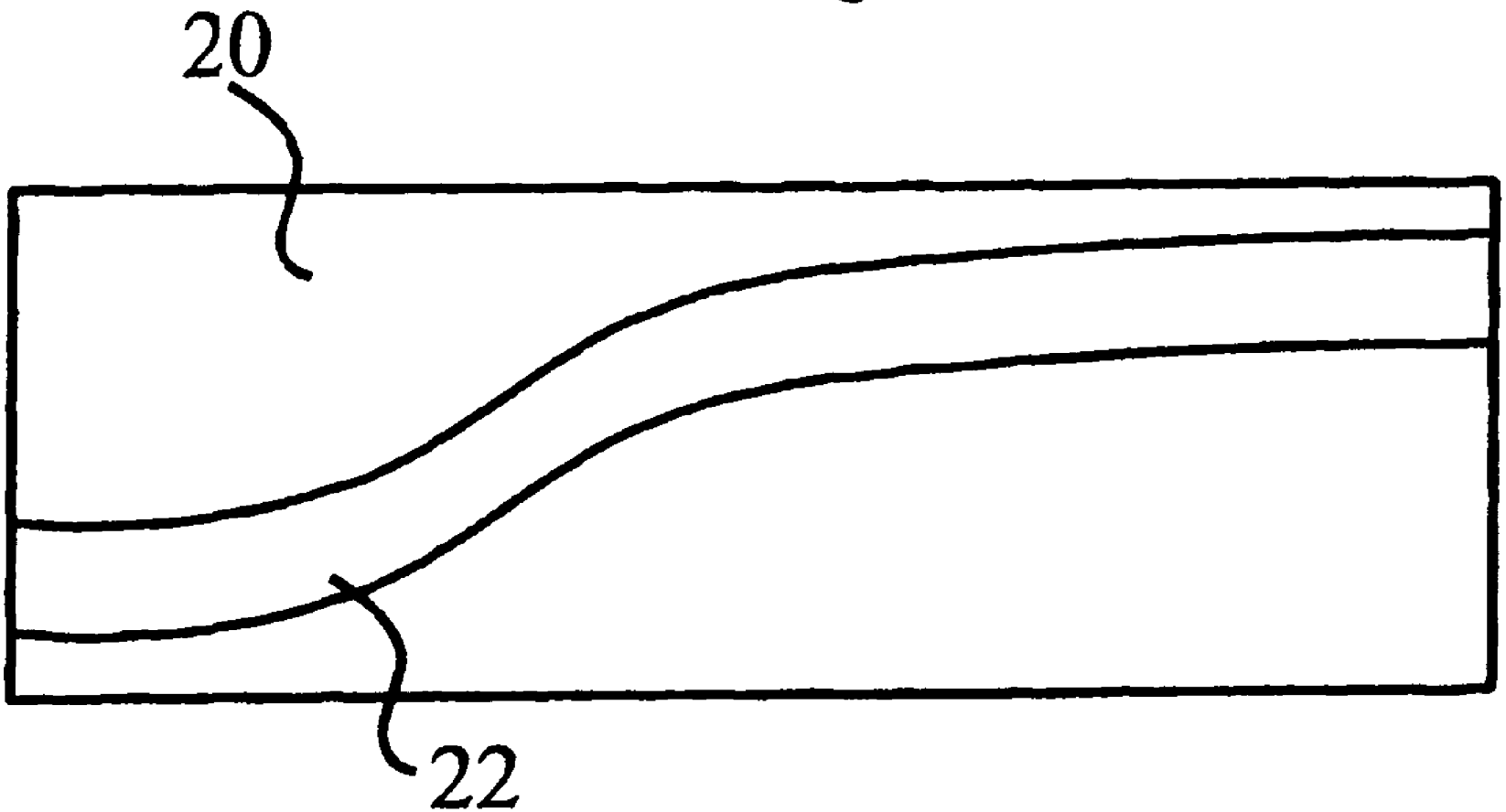
FIG. 3 shows a side view of a machine with a control groove according to one possible embodiment.

FIG. 3 shows a side view of a machine with a control groove according to one possible embodiment. In this possible embodiment, the machine 20 has a control groove 22 for the controlled or desmodromic movement of the lifter rod 11 toward its corresponding screw head, and away from its corresponding screw head upon bottles being capped. FIG. 3 shows the control groove 22 starting from the left side of the machine 20, and continuing to the right side of the machine. The control groove 22 continues around to the other side of the machine 20 so that the groove 22 meets itself again at its starting position. The movement of the cam through the control groove from the left to the right, as shown in FIG. 3, controls the upward movement of the lifter rod 11. As the cam continues to the other side of the machine 20, the right to left movement of the cam through the control groove 22 controls the downward movement of the lifter rod 11. In this manner, the cam continues to cycle through the groove, lifting and lowering the lifter rod 11 continuously in a controlled manner.

The present application was described above on the basis of one exemplary embodiment. It goes without saying that modifications and variations are possible without thereby going beyond the scope of the teaching of the present application.

The present application relates to a device for the capping of bottles or similar containers with a screw cap, on the periphery of a rotor that can be driven in rotation around a vertical machine axis, at least one capping position is provided, which has a screw head that can be driven in rotation, a bottle carrier and a lifting element which can be moved in a first lifting direction to bring the associated container carrier closer to the screw head, and in a second direction opposite to the first lifting direction to move the container carrier away from the screw head. The hub element can be moved in both hub directions desmodromically by a cam control system.

One feature or aspect of an embodiment is believed at the time of the filing of this patent application to possibly reside broadly in a beverage bottle screwtop closing arrangement configured to screw screwtops onto filled screwtop beverage bottles in a beverage bottling plant; said screwtop beverage bottle capper comprising: a rotor being disposed on a vertical axis; a motor system being configured to rotate said rotor about a vertical axis; a rotatable vertical machine column; said rotor being connected to said vertical machine column to permit rotation of said rotor about said vertical machine column; a plurality of closing devices being disposed on the periphery of said rotor; each of said plurality of closing devices comprising a container carrier element being configured and disposed to receive and hold filled bottles; each of said plurality of closing devices comprising a screw head being configured and disposed to screw screw caps onto screwtop bottles upon bottles being filled; each of said plurality of closing devices comprising a drive motor being configured and disposed to drive each of said plurality of closing devices to screw a cap onto a screwtop bottle; a first beverage bottle closing machine conveyor arrangement being configured and disposed to move bottles into said beverage bottle closing machine; said first beverage bottle closing machine conveyor arrangement comprising a star wheel structure; a lifting arrangement being configured and disposed to move screwtop bottles to be closed in a first lifting direction toward its corresponding screw head, and to hold said lifting arrangement in a position to permit a screw cap to be screwed onto a screwtop bottle; said lifting arrangement being configured and disposed to move screwtop bottles in a second lowering direction away from its corresponding screw head upon screwtop bottles being closed; said lifting arrangement comprising: a lifter rod being disposed vertically in said beverage bottle closing machine; a guide rod being disposed in a first guide sleeve and being configured to guide said carrier element; said guide rod being held on said lifter rod with a second guide sleeve, which second guide sleeve is configured and disposed to guide said guide rod; a helical compression spring being disposed on said lifter rod and being configured to apply a force to said container carrier element to permit said carrier element to press bottles to be capped against its corresponding screw head and to compensate for tolerances of the screw caps and the screwtop bottles; a cam structure being connected to said lifter rod and being configured and disposed to move said lifter rod in a first lifting direction, desmodromically, toward its corresponding screw head, and to hold said lifter rod in a position to permit a screw cap to be screwed onto a screwtop bottle; said cam structure being configured and disposed to move said lifter rod in a second lowering direction away from its corresponding screw head upon screwtop bottles being closed; said cam structure comprising: a cam roller being configured and disposed to rotate freely around an axis which is radial with respect to the vertical rotor axis; a stationary control groove being configured and disposed to receive said cam roller, and to permit rotation of said cam roller within said control groove; said stationary control groove comprising a top control surface and a bottom control surface; said bottom control surface being configured to control the first lifting direction of said lifter rod toward its corresponding screw head; and said top control surface being configured to control the second lowering direction of said lifter rod away from its corresponding screw head upon screwtop bottles being closed with a screw cap; a second beverage bottle closing machine conveyor arrangement being configured and disposed to move bottles out of said beverage bottle closing machine; said second beverage bottle screwtop closing machine conveyer arrangement comprising a star wheel structure.

Another feature or aspect of an embodiment is believed at the time of the filing of this patent application to possibly reside broadly in a screwtop bottle capper configured to screw screwtops onto bottles in a bottling plant comprising: a plurality of closing devices being configured to screw screwcaps onto a screwtop bottle; each said closing device comprising: a container carrier element being configured and disposed to receive and hold screwtop bottles; a lifting apparatus being configured and disposed to lift said container carrier element in a first lifting direction toward its corresponding closing device, and to move said container carrier element in a second lowering direction away from its corresponding closing device upon screwtop bottles being closed; a resilient member being disposed on said lifting apparatus; and said resilient member being configured to resiliently apply force to raise a screwcap bottle toward its corresponding closing device and to permit said container carrier element to compensate for tolerances of the screw caps and the screwtop bottles in order to assist in the capping of screwtop bottles; and said screwtop bottle capper further comprising: a cam structure being connected to said lifting apparatus; said cam structure being configured and disposed to lift said lifting apparatus in a first lifting direction toward its corresponding closing device, and to hold said lifting apparatus in a position to permit a screw cap to be screwed onto a screwtop bottle; and said cam structure being configured and disposed to move said lifting apparatus in a second lowering direction away from its corresponding closing device upon screwtop bottles being closed.

A further feature or aspect of an embodiment is believed at the time of the filing of this patent application to possibly reside broadly in a screwtop container closing arrangement configured to screw screwtops onto screwtop containers in a container filling apparatus, said screwtop container closing arrangement comprising: a container inlet being configured and disposed to permit containers to enter said screwtop container closing arrangement; a plurality of container closing stations; each said container closing station comprising: a screw capper being configured to screw screw caps onto screwtop containers; a container holding arrangement being configured and disposed to receive and hold, lift and lower screwtop containers to permit screw caps to be screwed onto screwtop containers by its corresponding screw capper; a lifting apparatus being configured and disposed to lift said container holding arrangement in a first lifting direction toward its corresponding screw capper, and to move said container holding arrangement in a second lowering direction away from its corresponding screw capper upon screwtop containers being closed; and said lifting apparatus comprising: a resilient member; and said resilient member being configured to resiliently apply force to raise a screwtop container toward its corresponding screw capper; a cam structure being connected to said lifting apparatus; said cam structure being configured and disposed to lift each said lifting apparatus in a first lifting direction toward its corresponding screw capper, and to hold each said container holding arrangement in a position to permit a screw cap to be screwed onto a screwtop container and further being configured and disposed to move each said lifting apparatus in a second lowering direction away from its corresponding screw capper upon screwtop containers being closed; and a container outlet being configured and disposed to permit closed containers to exit said screwtop container closing arrangement.

One feature or aspect of an embodiment is believed at the time of the filing of this patent application to possibly reside broadly in a device for capping bottles or similar containers each with a screw cap with at least one capping position formed on the periphery of a rotor that can be driven in rotation around a vertical machine axis or rotor axis, which capping position has a screw head that can be driven in rotation to apply the respective screw cap to the container to be capped by screwing, and has a container carrier, with a lifting element for each capping position, which can be moved in a first lifting direction to move the corresponding container carrier with the container to be capped toward the screw head, and in a second direction, which is opposite to the first, to remove the container carrier with the capped container from the screw head, with a cam control system for the reciprocating movement of the lifting element, and with at least one spring element that applies an initial load the container carrier toward the screw head, characterized by the fact that the lifting element can be moved desmodromically in both directions, up and down, by the cam control system, and that the container carrier is in a driven connection by means of the at least one spring element with the lifting element.

Another feature or aspect of an embodiment is believed at the time of the filing of this patent application to possibly reside broadly in a device for capping bottles or similar containers, characterized by the fact that the cam control system has at least two control surfaces, of which one control surface controls the reciprocating movement of the hub element in the one lifting direction, and the other control surface controls the movement of the lifting element in the other direction of the reciprocating movement.

Yet another feature or aspect of an embodiment is believed at the time of the filing of this patent application to possibly reside broadly in a device for capping bottles or similar containers, characterized by the fact that the control surfaces are formed by the lateral surfaces of a common control groove.

Still another feature or aspect of an embodiment is believed at the time of the filing of this patent application to possibly reside broadly in a device for capping bottles or similar containers, characterized by at least one cam roller that interacts with the control surfaces.

A further feature or aspect of an embodiment is believed at the time of the filing of this patent application to possibly reside broadly in a device for capping bottles or similar containers, characterized by the fact that the lifting element is a lifter rod that is oriented with it axis in the direction of the reciprocating movement or parallel to the axis of the rotor, and can be moved axially for the lifting movement.

Another feature or aspect of an embodiment is believed at the time of the filing of this patent application to possibly reside broadly in a device for capping bottles or similar containers, characterized by the fact that the at least one spring element acts between the container carrier or a carrier element that has this container carrier and the lifter rod.

Yet another feature or aspect of an embodiment is believed at the time of the filing of this patent application to possibly reside broadly in a device for capping bottles or similar containers, characterized by the fact that the at least one spring element is a compression spring that surrounds the lifter rod, and is supported with one end on a part of the container carrier that is guided on the lifter rod or of a holding element that has said container carrier, and with a second end on a leaf spring that is provided on the lifter rod and applies an initial load to the container carrier in the first lifting direction.

Still another feature or aspect of an embodiment is believed at the time of the filing of this patent application to possibly reside broadly in a device for capping bottles or similar containers, characterized by a stop that limits the movement of the container carrier in the first lifting direction relative to the lifting element.

A further feature or aspect of an embodiment is believed at the time of the filing of this patent application to possibly reside broadly in a device for capping bottles or similar containers, characterized by the fact that the stop is provided on the lifting element.

Another feature or aspect of an embodiment is believed at the time of the filing of this patent application to possibly reside broadly in a device for capping bottles or similar containers, characterized by the fact that a plurality of capping positions are formed on the periphery of the rotor.

Yet another feature or aspect of an embodiment is believed at the time of the filing of this patent application to possibly reside broadly in a device for capping bottles or similar containers, characterized by the fact that the cam control system is provided underneath the container carrier.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. patents assigned to the Assignee herein, namely: U.S. Pat. No. 4,911,285; U.S. Ser. No. 4,944,830; U.S. Ser. No. 4,950,350; No. 4,976,803; U.S. Ser. No. 4,981,547; U.S. Ser. No. 5,004,518; U.S. Ser. No. 5,017,261; No. 5,062,917; U.S. Ser. No. 5,062,918; U.S. Ser. No. 5,075,123; U.S. Ser. No. 5,078,826; No. 5,087,317; U.S. Ser. No. 5,110,402; U.S. Ser. No. 5,129,984; U.S. Ser. No. 5,167,755; No. 5,174,851; U.S. Ser. No. 5,185,053; U.S. Ser. No. 5,217,538; U.S. Ser. No. 5,227,005; No. 5,413,153; U.S. Ser. No. 5,558,138; U.S. Ser. No. 5,634,500; U.S. Ser. No. 5,713,403; No. 6,276,113; U.S. Ser. No. 6,213,169; U.S. Ser. No. 6,189,578; U.S. Ser. No. 6,192,946; No. 6,374,575; U.S. Ser. No. 6,365,054; U.S. Ser. No. 6,619,016; U.S. Ser. No. 6,474,368; No. 6,494,238; U.S. Ser. No. 6,470,922; and No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of bottling systems which may possibly be utilized or adapted for use in at least one possible embodiment may possibly be found in the following U.S. Pats Nos. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The corresponding foreign patent publication applications, namely, Federal Republic of Germany Patent Application No. 10 2004 041 749.0, filed on Aug. 28, 2004, having inventor Herbert Bernhard, and DE-OS 10 2004 041 749.0 and DE-PS 10 2004 041 749.0, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

| AT LEAST PARTIAL LIST OF TERMS | |
|---|---|
| 1 | Capper |
| 2 | Bottle |
| 2.1 | Bottle mouth |
| 2.2 | Thread |
| 2.3 | Flange |
| 3 | Screw cap |
| 4 | Rotor |
| 4.1, 4.2 | Rotor element |
| 5 | Capping station on the rotor |
| 6 | Screw head |
| 7 | Drive for screw head |
| 8 | Container carrier |
| 9 | Carrier element |
| 9.1, 9.2 | Guide sleeve |
| 10 | Guide rod |
| 11 | Lifter rod |
| 11.1 | Collar on the lifter rod |
| 12 | Cam roller |
| 13 | Bearing element |
| 14 | Control groove |
| 14.1, 14.2 | Control surface |
| 15 | Machine part |
| 16 | Compression spring |
| 17 | Leaf spring on lifter rod |
| Double arrow A | Reciprocating movement of the lifter rod 11 |
| RA | Rotor axis |

What is claimed is:

1. A rotary screwtop container capping arrangement configured to screw screw caps onto screwtop containers having neck rings configured to support the containers during capping, said screwtop container capping arrangement comprising:

a rotor having a central, vertical axis of rotation;

a plurality of container capping stations being disposed on the periphery of said rotor;

each of said container capping stations comprising:

a screw capper being configured to screw screw caps onto screwtop containers;

a container holding element being configured and disposed to receive and hold a neck ring of a threaded mouth portion of a screwtop container to hold and support the screwtop container;

a lifting element being configured and disposed to lift said container holding element in a first, lifting, direction toward its corresponding screw capper to permit capping of a screwtop container, and to move said container holding element in a second lowering direction away from its corresponding screw capper upon a screwtop container being capped;

a resilient member being disposed on said lifting element; and said resilient member being engaged with said container holding element to resiliently apply force to said container holding element to: raise a screwtop container toward said screw capper, press a screwtop container into engagement with said screw capper, and maintain engagement of a screwtop container with said screw capper during capping of a screwtop container by said screw capper;

a cam arrangement being configured and disposed to lift each said lifting element in a first, lifting, direction toward its corresponding screw capper, and to hold each said container holding element in a position to permit a screw cap to be screwed onto a screwtop container, and further being configured and disposed to move each said lifting element in a second, lowering, direction away from its corresponding screw capper upon screwtop containers being capped by said screw capper;

said cam arrangement comprising:

a cam roller being mounted on a lower end of said lifting element;

a stationary guide structure comprising a control groove therein being configured and disposed to receive said cam roller, and to permit rotation of said cam roller within said control groove;

said control groove comprising a top control surface and a bottom control surface;

said cam roller being disposed within said control groove of said stationary guide structure between said top control surface and said bottom control surface, wherein said top control surface is disposed above said cam roller and said bottom control surface is disposed below said cam roller;

said bottom control surface comprising at least one upwardly sloping portion being configured and disposed to contact and force said cam roller in an ascending movement from a lowered position in said stationary guide structure to force said lifting element in the first, lifting, direction toward its corresponding screw head;

said top control surface comprising at least one downwardly sloping portion being configured and disposed to contact and force said cam roller in a descending movement from a raised position in said stationary guide structure to force said lifting element in the second, lowering, direction away from its corresponding screw head upon screwtop containers being capped with a screw cap; and said control groove being configured and disposed to run uninterruptedly around the central rotational axis in a substantially circular path to continuously control the vertical position of said cam roller.

2. The screwtop container capping arrangement according to claim 1, wherein:

said screw capper comprises:

a capping device configured to hold a screw cap; and a spring connected to said capping device; and said spring is configured to resiliently apply force to said capping device to maintain engagement of said capping device with a screwtop container during capping of a screwtop container.

3. The screwtop container capping arrangement according to claim 2, wherein:

said spring of said screw capper is configured to be compressed to compensate for tolerances in the length of a threaded mouth portion of a screwtop container; and said resilient member is configured to be compressed to compensate for tolerances in the length of a threaded mouth portion of a screwtop container.

4. The screwtop container capping arrangement according to claim 3, wherein:

said lifting element is a lifter rod;

said lifter rod is elongated and has a central longitudinal axis;

said central longitudinal axis of said lifter rod is disposed substantially parallel to the direction of the reciprocating movement of said lifter rod; and said lifter rod is configured and disposed to be moved axially by said cam arrangement.

5. The screwtop container capping arrangement according to claim 4, wherein:

said resilient member has a first end in contact with a bottom surface of said container carrier element;

said lifter rod comprises a leaf spring disposed to project substantially from said lifter rod; and said resilient member has a second end disposed opposite said first end and supported on said leaf spring.

6. The screwtop container capping arrangement according to claim 5, wherein said resilient member comprises a helical compression spring comprising a plurality of coils disposed in a helix and coiled around a portion of said lifter rod.

7. The screwtop container capping arrangement according to claim 6, wherein said container screwtop capping arrangement comprises a stop that limits the movement of said container holding element in the first lifting direction relative to said lifter rod.

8. The screwtop container capping arrangement according to claim 7, wherein said stop is provided on and projects substantially radially from said lifter rod.

9. The screwtop container capping arrangement according to claim 8, wherein said cam arrangement is disposed below said container carriers.

10. The screwtop container capping arrangement according to claim 1, wherein:

said lifting element is a lifter rod;

said lifter rod is elongated and has a central longitudinal axis;

said central longitudinal axis of said lifter rod is disposed substantially parallel to the direction of the reciprocating movement of said lifter rod; and said lifter rod is configured and disposed to be moved axially by said cam arrangement.

11. The screwtop container capping arrangement according to claim 10, wherein:

said resilient member has a first end in contact with a bottom surface of said container carrier element;

said lifting element comprises a leaf spring disposed to project substantially radially from said lifting element; and said resilient member has a second end disposed opposite said first end and supported on said leaf spring.

12. The screwtop container capping arrangement according to claim 11, wherein said resilient member comprises a helical compression spring disposed to surround at least a portion of said lifting element passing therethrough.

13. The screwtop container capping arrangement according to claim 12, wherein said resilient member comprises a helical compression spring disposed to surround at least a portion of said lifting element passing therethrough.

14. The screwtop container capping arrangement according to claim 13, wherein said container screwtop capping arrangement comprises a stop that limits the movement of said container holding element in the first lifting direction relative to said lifter rod.

15. The screwtop container capping arrangement according to claim 14, wherein said stop is provided on and projects substantially radially from said lifter rod.

16. The screwtop container capping arrangement according to claim 15, wherein said cam arrangement is disposed below said container carriers.

17. The screwtop container capping arrangement according to claim 1, wherein:

said resilient member has a first end in contact with a bottom surface of said container carrier element;

said lifting element comprises a leaf spring disposed to project substantially radially from said lifting element; and said resilient member has a second end disposed opposite said first end and supported on said leaf spring.

18. The screwtop container capping arrangement according to claim 17, wherein said resilient member comprises a helical compression spring disposed to surround at least a portion of said lifting element passing therethrough.

19. The screwtop container capping arrangement according to claim 18, wherein said resilient member comprises a helical compression spring disposed to surround at least a portion of said lifting element passing therethrough.

20. The screwtop container capping arrangement according to claim 19, wherein said cam arrangement is disposed below said container carriers.

* * * * *